US007311341B2

(12) United States Patent
Coleman et al.

(10) Patent No.: US 7,311,341 B2
(45) Date of Patent: Dec. 25, 2007

(54) LOCK MECHANISM

(75) Inventors: Peter J Coleman, West Midlands (GB); Gurbinder S. Kalsi, West Midlands (GB)

(73) Assignee: ArvinMeritor Light Vehicle Systems (UK) Limited, West Midlands (GB)

( * ) Notice: Subject to any disclaimer, the term of this patent is extended or adjusted under 35 U.S.C. 154(b) by 0 days.

(21) Appl. No.: 11/545,205

(22) Filed: Oct. 10, 2006

(65) Prior Publication Data

US 2007/0029815 A1 Feb. 8, 2007

Related U.S. Application Data

(62) Division of application No. 10/826,682, filed on Apr. 16, 2004, now Pat. No. 7,125,057.

(30) Foreign Application Priority Data

Apr. 24, 2003 (GB) ..... 0309266.5

(51) Int. Cl.
*E05C 3/06* (2006.01)

(52) U.S. Cl. ..... 292/216; 292/DIG. 23

(58) Field of Classification Search ..... 292/216, 292/201, DIG. 23
See application file for complete search history.

(56) References Cited

U.S. PATENT DOCUMENTS 5,538,298 A 7/1996 Ikeda
5,584,515 A * 12/1996 Silye ..... 292/201
5,722,272 A 3/1998 Bridgeman et al.
6,116,664 A 9/2000 Wegner
6,199,923 B1 * 3/2001 Rice et al. ..... 292/216
6,474,706 B1 * 11/2002 Kalsi ..... 292/216
2002/0056996 A1 * 5/2002 Fukunaga et al. ..... 292/216
2002/0060549 A1 * 5/2002 Zintler ..... 292/216
2005/0082843 A1 * 4/2005 Edgar ..... 292/216

FOREIGN PATENT DOCUMENTS

DE 196 19 849 7/1997

OTHER PUBLICATIONS

European Search Report dated Sep. 8, 2004.

* cited by examiner

*Primary Examiner*—Gary Estremsky
(74) *Attorney, Agent, or Firm*—Carlson, Gaskey & Olds

(57) ABSTRACT

A lock mechanism for a vehicle door latch includes a lock actuator drivingly coupled to a lock link for movement of the lock link between a first position corresponding to a locked state of a latch and a second position corresponding to an unlocked state of the latch. The mechanism further includes a superlock actuator drivingly connected to a superlock link slidably mounted for movement of the superlock link between a third position corresponding to a superlocked state of the latch and a fourth position corresponding to a non-superlocked state of the latch. A fixed abutment surface and an inside lock lever are mounted such that movement of the lock link between the first and second positions may be achieved when the superlock link is in the fourth position. When the superlock link is the third position, the relative positions of the inside lock lever, the superlock link and the abutment surface prevent movement of the lock link between the first and second positions.

10 Claims, 6 Drawing Sheets

FIG. 4 LOCKED
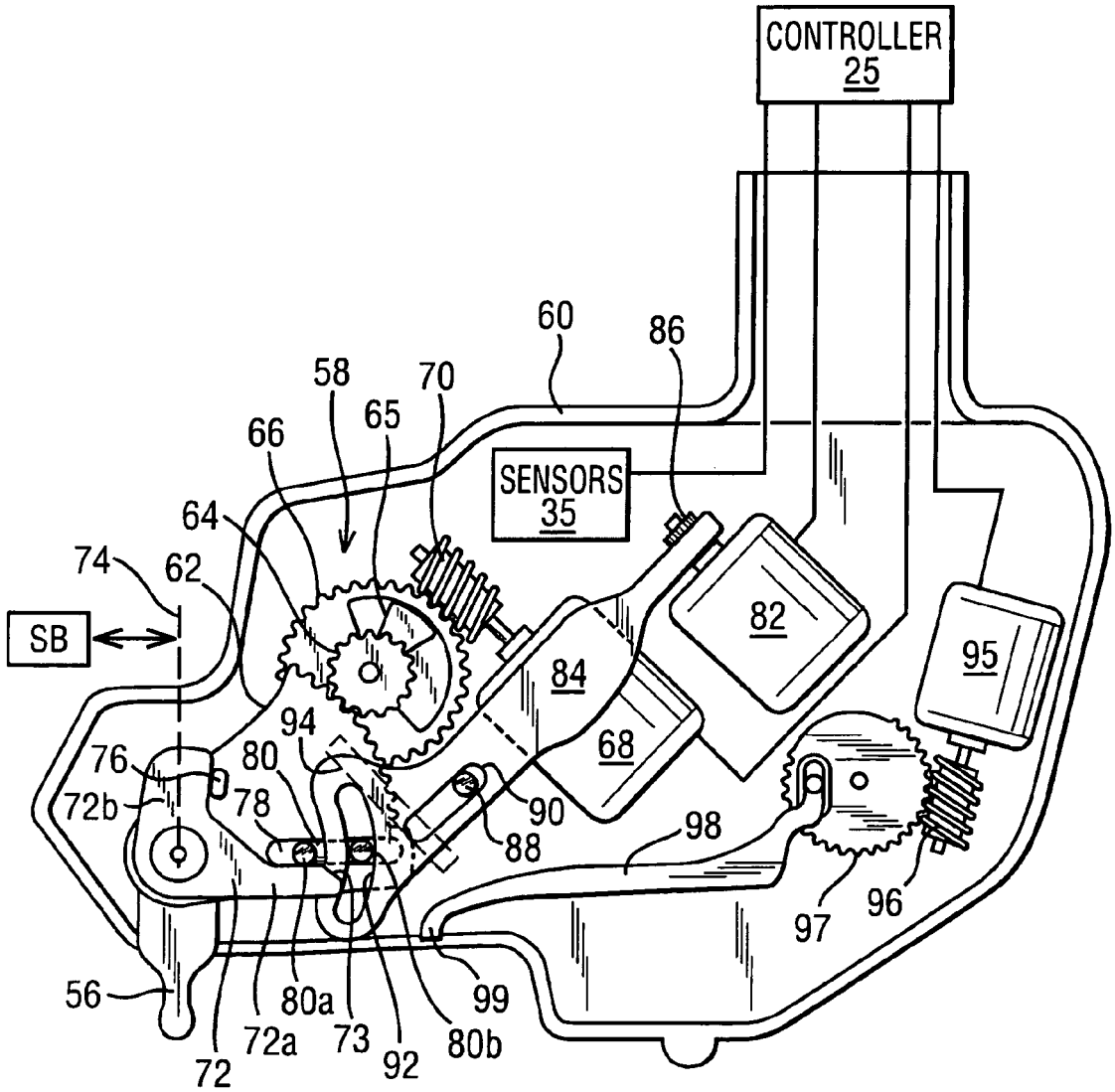

SUPERLOCKED

UNLOCKED

LOCK MECHANISM

This application is a divisional application of U.S. Ser. No. 10/826,682, which was filed on Apr. 16, 2004 now U.S. Pat. No. 7,125,057 which claims priority to United Kingdom Patent Application GB 0309266.5 filed on Apr. 24, 2003.

TECHNICAL FIELD

The present invention relates generally to a lock mechanism for a vehicle door latch including a superlock function.

BACKGROUND OF THE INVENTION

Known latches are used to releasably secure vehicle doors in a closed position. The latch is mounted on the door and includes a retention plate having an opening which receives a striker that is typically mounted on a fixed structure of the vehicle. A latch bolt in the form of a rotatable claw having a mouth is typically pivotably mounted to the retention plate. The claw is provided with fully latched and first safety abutments against which a pawl, also pivotally mounted to the retention plate, may engage. As the door is closed, the striker enters the opening of the retention plate and the mouth of the claw, rotating the claw and engaging the pawl with one of the abutments, thereby releasably retaining the claw and maintaining the door in a closed position. Mechanical or electrical linkages are provided from the latch to handles, buttons and the like to control the operation of the latch.

Latches on different vehicles, and in particular different latches on a particular vehicle, can have different security/operating modes. Thus, a latch may be a) openable by operation of an inside door handle, b) openable by operation of an outside door handle, c) lockable by operation of an inside sill button or the like, d) lockable by operation of an outside key barrel or the like, e) lockable by operation of a remote keyless entry (RKE) device, and f) superlockable by operation of a RKE device or outside key barrel.

The state of a particular latch may include one or more of the following modes: a) unlocked, b) locked (i.e., operation of an outside door handle does not unlatch the latch, but operation of an inside door handle does unlatch the latch), c) superlocked (wherein any number of operations of an inside door handle or an outside door handle, in any order, does not unlatch the latch), and d) child safety on (wherein operation of an inside door handle does not unlatch the latch, but operation of an outside door handle may or may not unlatch the latch, depending upon whether the door is locked or unlocked).

Furthermore, a certain sequence of events can be used to perform desired functions. With a locked latched door, operation of an inside door handle may unlatch the latch and, at the same time, unlock the latch. Upon subsequent closing of the door, the door is unlocked and can then be opened by operation of the outside door handle. This is known as override unlocking and prevents vehicle keys from being locked in the vehicle. This mode of operation is also useful to provide for opening of a locked door in the child safety on mode. Even though operation of the inside door handle does not unlatch the latch, it unlocks the latch and a subsequent operation of an outside door handle enables the latch to be unlatched.

A sill button associated with certain types of latches (typically driver door latches) cannot be depressed when the door is open. This also prevents keys from being locked in the vehicle. The only ways of externally locking such a latch are to either close the door and insert a key into a key barrel to lock the latch or to operate a RKE device.

Certain other types of latches require an outside door handle to be lifted when the door is in the open position to enable the sill button to be pushed down to lock the door when the door is subsequently closed. Thus, the driver has to perform a specific sequence of events (i.e., lift the outside door handle and then depress the sill button) to lock the door. This again is aimed at preventing keys from being locked in the vehicle.

There are several modes of operation of known door locks, and the way in which these functions are performed are typically carried out by mechanisms of the door latch, as opposed to mechanisms remote from the door latch. Ultimately, whichever mechanism is used, the door will only open when the pawl is moved out of engagement from the claw. The locking, the superlocking, and the child safety modes all relate to either providing a connection between a door handle or a power actuator (e.g., an electric motor) driven under the influence of a signal received from an RKE device or door handle and the pawl to move the pawl or breaking or blocking the connection to prevent movement of the pawl.

Car door latches are typically mounted at the rear of a car door, and the car door is pivotally mounted at a front edge. Typically, an inside door handle is mounted on the inside of the door and towards the front edge, and therefore a connection needs to be provided to connect the inside door handle with the door latch. Depending on the location of the inside door handle and the nature of the connection with the latch (e.g., in some cases the nature of the connection is simply to provide the unlatching of the door, whereas in other cases the nature of the connection is to provide for unlocking and unlatching of the door), different latches require different types of connections and connection orientations to be able to actuate the door latch.

In doors fitted with a sill button or another visual status indicator to indicate the locked state of a particular latch and the changing of that locked state, superlocking latches can be used to manually manipulate the sill button or the visual status indicator to provide an indication corresponding to the particular latch being unlocked, although the latch in fact remains superlocked. This situation is undesirable since it results in uncertainty in the mind of a vehicle user as to whether the latch remains superlocked, locked or unlocked. In turn, this may result in a user pulling on an inside or outside handle with excessive force to unlatch the latch under the misconception that it is unlocked when it is not, which may cause damage to the latch or associated linkages.

The present invention seeks to overcome or at least mitigate the problems of the prior art.

SUMMARY OF THE INVENTION

The present invention provides a lock mechanism for a vehicle door latch including a lock actuator drivingly coupled to a lock link for movement of the lock link between a first position corresponding to a locked state of the latch and a second position corresponding to an unlocked state of the latch. The mechanism further includes a superlock actuator drivingly connected to a superlock link slidably mounted for movement of the superlock link between a third position corresponding to a superlocked state of the latch and a fourth position corresponding to a non-superlocked state of the latch. A fixed abutment formation and an inside lock lever are mounted such that movement of the lock link between the first and second positions may be achieved when the superlock link is in the fourth position. When the super-lock link is in the third position, the relative positions of the inside lock lever, the superlock link and the abutment formation prevents movement of the lock link between the first and second positions.

The present invention also provides a child safety mechanism for a vehicle door latch including an inside release link, a wedge block and a wedge block support. The wedge block is movable on the support between a first position, in which the inside release link is in a child safety off position and is actuable by a linkage from an inside door handle to permit a latch to be released and a second position, in which the wedging action of the wedge block places the release link in a child safety on position such that the release link is not actuable by the linkage.

BRIEF DESCRIPTION OF THE DRAWINGS

Embodiments of the present invention are now described, by way of example only, with reference to the accompanying drawings in which:

FIG. 4 is a side view of another portion of the latch of FIG. 1 as viewed from direction A of FIG. 1 when in a locked state;

DETAILED DESCRIPTION OF THE PREFERRED EMBODIMENT

Figure 1:
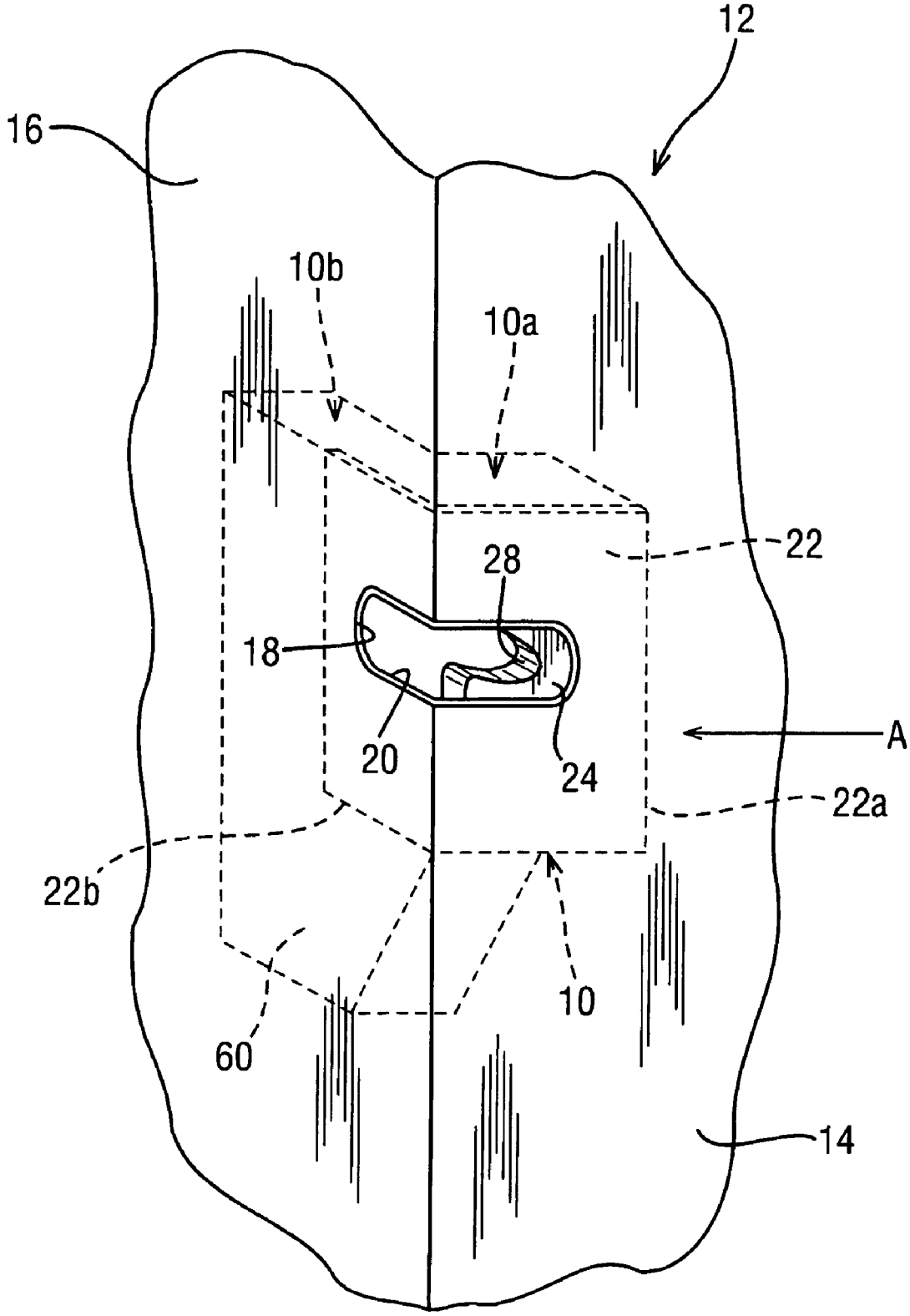
FIG. 1 is a perspective view of a latch incorporating a lock mechanism according to an embodiment of the present invention when fitted to the vehicle passenger door.

Referring to FIG. 1, a latch 10 is mounted to a vehicle side passenger door 12 at the intersection of a shut face 14 (at the door trailing edge) and an inside face 16. A portion of the door is cut away to provide an opening 18 spanning the intersection, and the opening 18 is capable of receiving a striker (not shown) mounted to a fixed portion of the vehicle, such as a door pillar (not shown). A mouth 20 having a similar dimension is also provided in a retention plate 22 of the latch 10. The latch 10 is generally L-shaped in plan view and includes a first region 10*a* arranged proximate to the shut face 14 and a second region 10*b* arranged proximate the inside face 16 when installed in the side passenger door 12.

Figure 2:
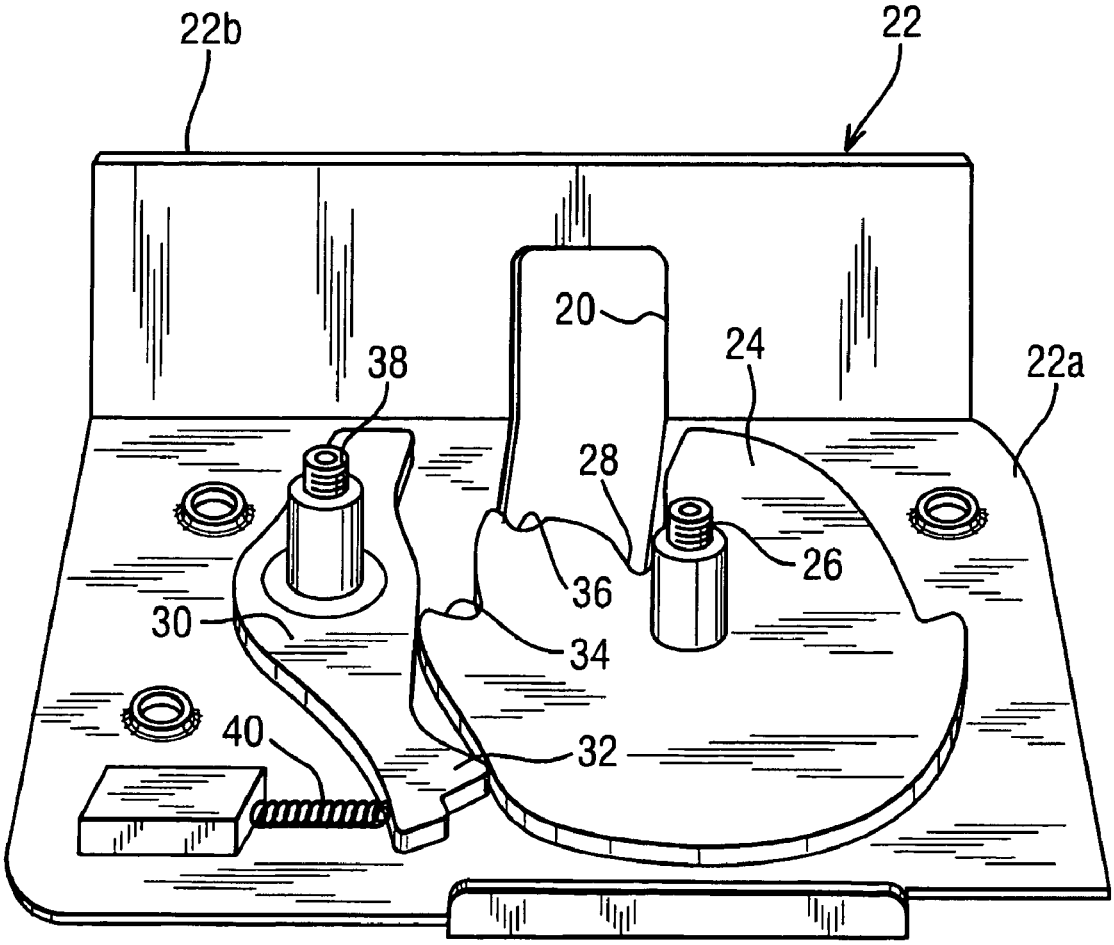
FIG. 2 is a perspective view of a partially assembled portion of the latch of FIG. 1.

Referring to FIG. 2, a claw 24 (also partially visible in FIG. 1) is pivotally mounted to an inner face of the retention plate 22 in the first region 10*a* of the latch 10 by a pivot pin 26 and is arranged to receive the striker in a mouth 28 of the claw 24. In FIGS. 1 and 2, the claw 24 is shown in a released state. The claw 24 is biased into an open position by a resilient member, such as a spring (not shown). However, as the claw 24 rotates by relative movement between the striker and the latch 10 during closure of the side passenger door 12, the claw 24 may be retained by a pawl 30 by engagement of a pawl tooth 32 of the pawl 30 with either a first safety abutment 34 or a fully latched abutment 36 on a periphery of the claw 24. The pawl 30 is pivotally mounted about a second pivot pin 38 and is resiliently biased by a spring 40 into contact with the claw 24, as known.

Figure 3:
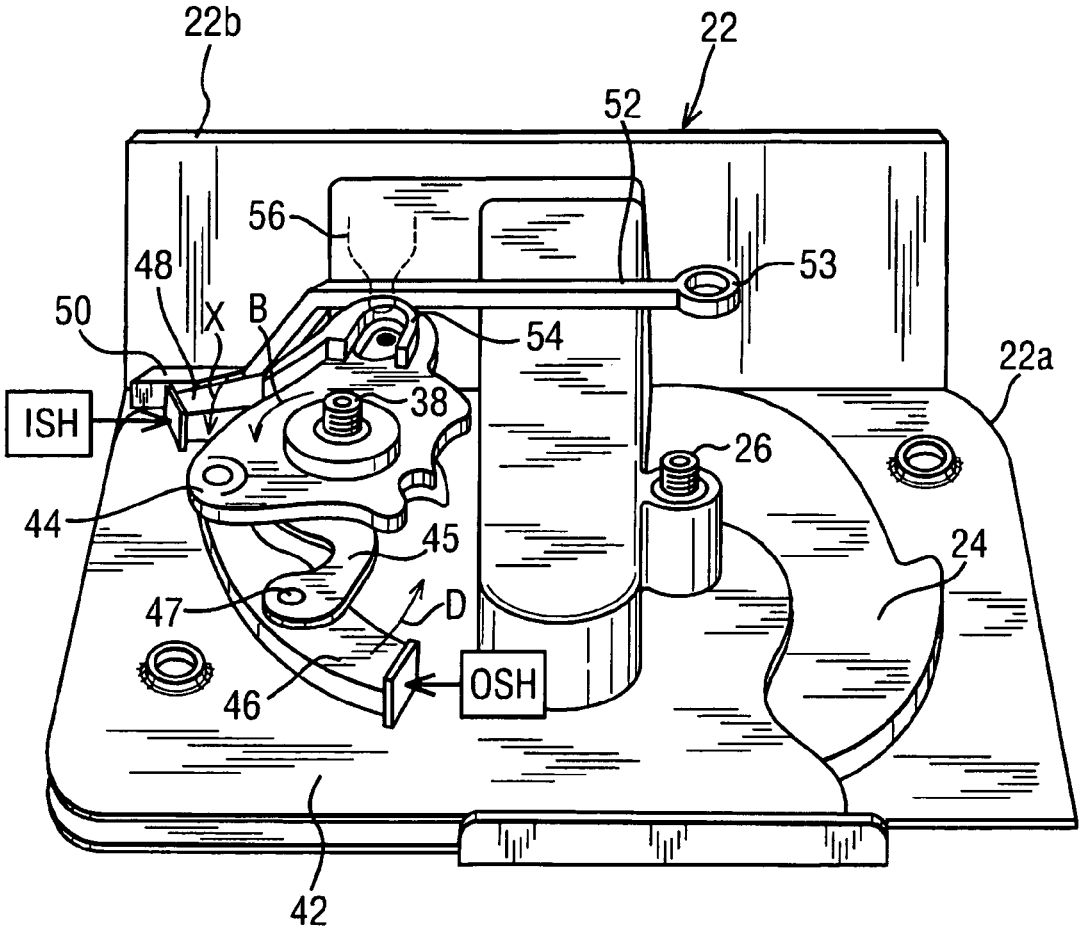
FIG. 3 is a perspective view of the latch of FIG. 2 at a later stage of assembly.
Figure 3A:
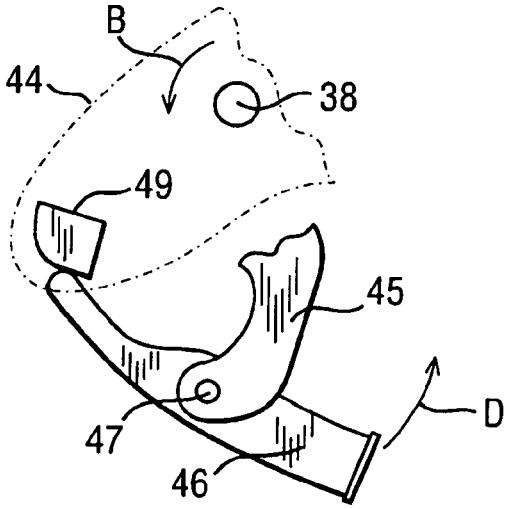
FIG. 3*a* is a side view of a portion of the latch shown in FIG. 3.

As shown in FIGS. 3 and 3A, a cover plate 42 is placed on the latch 10 to partially obscure the claw 24 and totally obscure the pawl 30. The cover plate 42 further shrouds the mouth 20 of the retention plate 22 to minimize the ingress of dirt, etc. into the latch 10 via the mouth 28.

A release link 46 is pivotably connected to a release link connector 45 by a pin 47. The release link connector 45 extends from a pawl lifter (not shown), which rotates about the second pivot pin 38. A second release link 48 is similarly connected. The pawl lifter and the release link connector 45 rotate together about the second pivot pin 38. The pawl lifter is biased in a direction B by a spring (not shown). Rotation of a main lock lever 44 in the direction B rotates the release link 46 and the second release link 48 counter-clockwise in a direction D about the pin 47 by the action of a cam portion 49 of the main lock lever 44 to move to a locked position.

The release link 46 and the second release link 48 are biased in a clockwise direction by a spring (not shown). When the main lock lever 44 returns to the unlocked position, the release link 46 and the second release link 48 also return to their unlocked positions.

The latch 10 further includes a child safety mechanism in the form of a slidable wedge-shaped block 50 which is supported by the retention plate 22 at the intersection between a shut face portion 22*a* and an inside face portion 22*b*. As shown in FIG. 3, the mechanism is shown in a child safety off condition. If the wedge-shaped block 50 is slid to the right as shown in FIG. 3, the resulting wedging action pivots the second release link 48 in a counter-clockwise direction X such that the linkage from an inside handle ISH misses the second release link 48. If the inside handle ISH is actuated, it cannot release the latch 10, irrespective of the position of the main lock lever 44. The child safety mechanism may be moved manually by use of a suitable mechanism, but in this embodiment it is connected to a power actuator via a suitable linkage, such as an arm 52, as described in greater detail below.

The main lock lever 44 further includes a recess formation 54 engageable by a lock link 56 (shown in broken lines in FIG. 3) and pivotable about an axis substantially 90° to that of the main lock lever 44. Operation of the lock link 56 is discussed in greater detail below.

Figure 7:
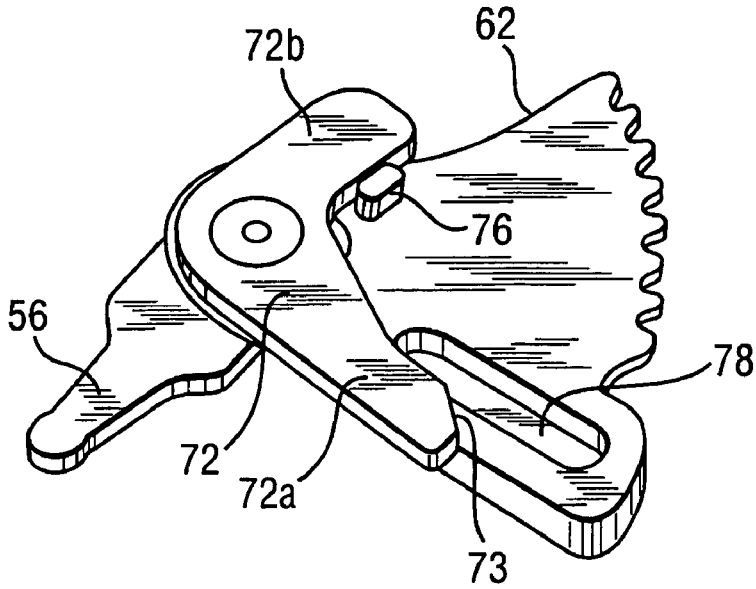
FIG. 7 is a perspective view of a lock link and an inside lock lever of the locking mechanism of FIG. 5.

Referring to FIGS. 4 and 7, a lock mechanism 58 is shown in more detail when viewed from direction A of FIG. 1. The lock mechanism 58 is located in the second region 10*b* of the latch 10 and essentially runs parallel to the inside face 16 of the side passenger door 12 when installed.

The lock link 56 is rotatably mounted on a housing 60 of the latch 10 and is fixed to a quadrant 62 so that rotation of the quadrant 62 causes rotation of the lock link 56. The quadrant 62 has gear teeth on the circumferential edge that engage with a pinion gear 64. The lock link 56 and the quadrant 62 may be integrally formed together as a single piece. The pinion gear 64 is coaxially pivotally mounted with a worm wheel 66 and has a dog clutch connection 65 between the pinion gear 64 and the worm wheel 66, which enables the pinion gear 64 to rotate through slightly less than 180° without rotation of the worm wheel 66. The worm wheel 66 is in turn driven by a lock power actuator in the form of a DC electric unlocking motor 68 via a worm gear 70. The electric unlocking motor 68 is capable of driving the worm wheel 66 in both clockwise and counter-clockwise directions. A controller 25 controls operation of the electric unlocking motor 68.

In the context of the present invention, the term "power actuator" should be understood to encompass any actuator driven from a vehicle power source, such as a vehicle battery. Specifically, the term should not be understood to mean a manually operable actuator, such as a door handle, whose power source is a vehicle user.

A manual inside lock lever 72 is coaxially mounted with respect to the quadrant 62 and the lock link 56 and is fixed for rotation together with a sill button lever 74 (illustrated schematically) and provided on the opposite face of the housing 60 to that shown. Thus, manipulation of a sill button SB (illustrated schematically) may cause the manual inside lock lever 72 to rotate in a clockwise or counter-clockwise direction. The sill button SB also provides a visual indication of the lock status of the latch 10.

The manual inside lock lever 72 is substantially L-shaped and has two arms 72*a* and 72*b*. The arm 72*a* terminates in an angled edge 73. The manual inside lock lever 72 is not rotationally fixed with the lock link 56 or the quadrant 62. However, the extent to which manual inside lock lever 72 may rotate relative to the quadrant 62 is restricted in a clockwise direction by a stop 76 capable of abutting the arm 72*b*.

Figure 9:
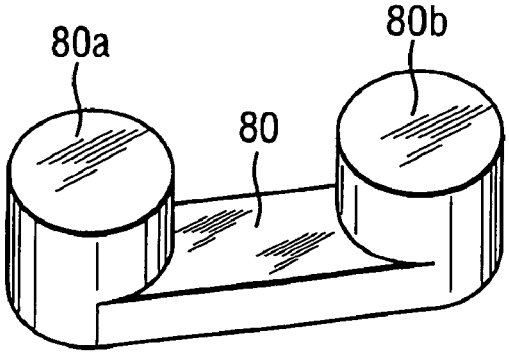
FIG. 9 is a perspective view of the superlock link of the locking mechanism of FIG. 5.

A radially extending trough or slot 78 is provided in the quadrant 62, and a superlock link 80 is slidably mounted in the trough or slot 78. As further shown in FIG. 9, the superlock link 80 is substantially U-shaped and has two parallel-spaced pins 80*a* and 80*b* projecting out of the plane of the quadrant 62. The first pin 80*a* limits relative rotation of the manual inside lock lever 72 in a counter-clockwise direction relative to the quadrant 62 by abutting the arm 72*a*.

Figure 8:
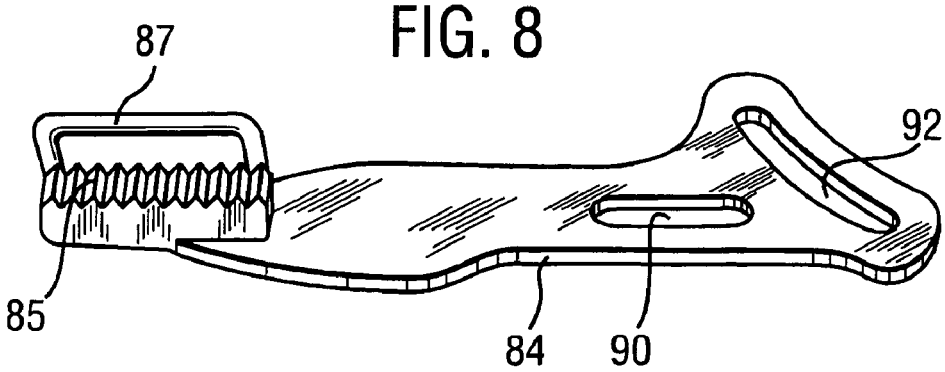
FIG. 8 is a perspective view of the underside of a superlock arm of the locking mechanism of FIG. 5.

The radial position of the superlock link 80 is controlled by a superlock power actuator in the form of a DC electric superlock motor 82. The controller 25 controls operation of the electric superlock motor 82. A superlock arm 84, the underside of which is shown in FIG. 8, provides a drive connection between the electric superlock motor 82 and the superlock link 80. The end of the superlock arm 84 proximate the electric superlock motor 82 is provided with a gear rack 85. Rotation of an output pinion 86 from the electric superlock motor 82 moves the superlock arm 84 along its longitudinal axis. The motion is guided by a pin 88 secured to the housing 60 and a slot 90 formed in the superlock arm 84. Engagement of the output shaft of the electric superlock motor 82 with a guide 87 holds the output pinion 86 in contact with the gear rack 85. The end of the superlock arm 84 remote from the electric superlock motor 82 terminates in an arcuate slot 92 arranged to receive the second pin 80*b* of the superlock link 80. The arcuate shape of the arcuate slot 92 enables the quadrant 62, and hence the superlock link 80, to pivot with minimal axial movement of the superlock arm 84.

An abutment formation 94 (shown in broken lines in FIG. 4) provided on the inside face of a top cover portion of the latch (not shown) mates with the housing 60 and is positioned at an acute angle relative to the trough or slot 78 when the quadrant 62 is positioned as shown in FIG. 4. The abutment formation 94 is further positioned such that it may abut the second pin 80*b* of the superlock link 80 when in its radially outermost position in the trough or slot 78 (shown in FIG. 5).

The second region 10*b* of the latch 10 further includes a child safety power actuator in the form of a DC electric motor 95 capable of driving the wedge-shaped block 50 (FIG. 3) via a worm gear 96, a worm wheel 97, an arm 98 and the arm 52 (FIG. 3). The controller 25 controls operation of the electric motor 95. A lug 99 of the arm 98 engages a complimentary aperture 53 on the arm 52 to transmit the drive.

In another embodiment, the second region 10*b* may also contain switches or other sensors 35 (illustrated schematically) capable of detecting the states of various latch components, and this information may be utilized by the controller 25 to control the latch functions.

Figure 6:
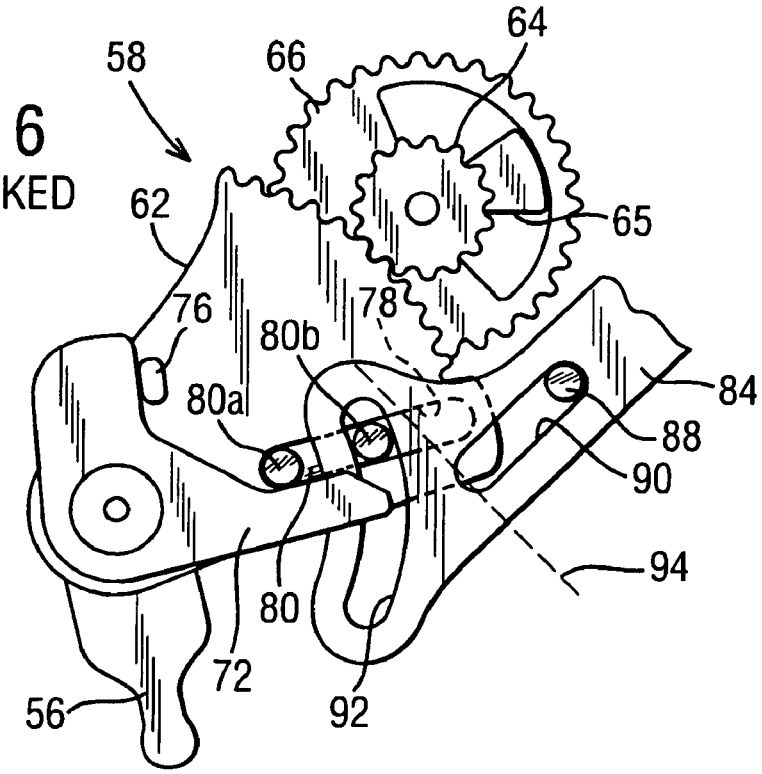
FIG. 6 is a detailed side view of the locking mechanism of FIG. 4 in an unlocked state.

Starting from the locked condition shown in FIG. 4 (with the superlock link 80 not being in the radially outermost position in the trough or slot 78), the latch 10 may be unlocked by lifting the sill button SB, causing the manual inside lock lever 72 to take up any lost motion between the arm 72*a* and the first pin 80*a*. The quadrant 62 then rotates counter-clockwise in conjunction with the lock link 56. This in turn moves the main lock lever 44 into an unlocked position and enables the latch 10 to be opened either by actuation of an outside handle OSH or the inside handle ISH (unless child safety is on). Rotation of the quadrant 62 also rotates the pinion gear 64 in a clockwise direction. Due to the dog clutch arrangement 65, this does not result in back driving of the electric unlocking motor 68. After this unlocking operation, the lock mechanism 58 is positioned as shown in FIG. 6.

Starting again from the locked condition shown in FIG. 4, the latch 10 may also be power unlocked by the electric unlocking motor 68 in response to a signal from a remote keyless entry device (not shown). In this situation, the controller 25 signals the powering of the electric unlocking motor 68, causing the pinion gear 64 to rotate clockwise via the worm gear 70 and the worm wheel 66. As with manual unlocking, the quadrant 62 and the lock link 56 rotate counter-clockwise and move the main lock lever 44 to an unlocked position. The counter-clockwise rotation also rotates the sill button lever 74 counter-clockwise and lifts the sill button SB due to contact between the stop 76 and the arm 72*b*.

Figure 5:
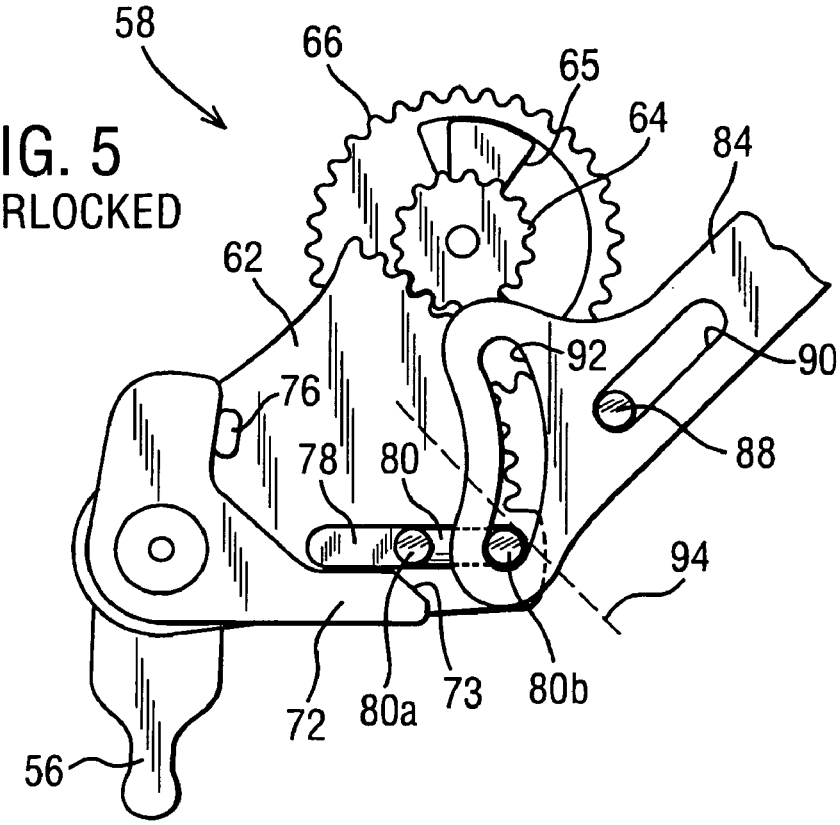
FIG. 5 shows a side view of the locking mechanism according to an embodiment of the present invention in detail when in a superlocked state.

FIG. 5 shows the lock mechanism 58 in a superlocked state. The electric superlock motor 82 has moved the superlock arm 84 away from the lock link 56, moving the superlock link 80 to the radially outermost position within the trough or slot 78. In this position, the second pin 80*b* abuts the abutment formation 94. If a user of the vehicle attempts to lift the sill button SB to cause counter-clockwise rotation of the manual inside lock lever 72, the angled edge 73 of the manual inside lock lever 72 contacts the first pin 80*a* of the superlock link 80. The angled edge 73 acts as a wedge to urge the superlock link 80 radially outwardly against the end of the trough or slot 78 and against the abutment formation 94, preventing counter-clockwise rotation of the quadrant 62 and the lifting of the sill button SB. Therefore, the main lock lever 44 remains in its locked position and actuation of either the inside handle ISH or the outside handle OSH cannot release the latch 10.

When the lock link 56 and the quadrant 62 are rotated clockwise (either due to operation of the RKE or unlocking via the key resulting in drive from the electric unlocking motor 68), the lock link 56 drives the quadrant 62, and therefore the superlock link 80, counter-clockwise and the second pin 80*b* contacts the abutment formation 94. In turn, this causes the superlock link 80 to move radially inwards in the trough or slot 78. Even if the manual inside lock lever 72 abuts the superlock link 80 at the start of the operation, the lost motion connection between the manual inside lock lever 72 and the quadrant 62 rotates the manual inside lock lever 72 clockwise relative to the quadrant 62 until the manual inside lock lever 72 abuts the stop 76 during counter-clockwise drive of the quadrant 62.

Thus, the wedging action between the angled edge 73, the first pin 80*a*, the abutment formation 94 and the second pin 80*b* does not occur and unlocking is not impeded. The manual inside lock lever 72 can rotate counter-clockwise and the second pin 80*b* is pushed further to the left by the abutment formation 94, thereby cancelling superlock. The electric superlock motor 82 is backdriven.

Changing the state of the latch 10 from unlocked to locked or superlocked is essentially the reverse of the unlocking and un-superlocking operations described above.

The lock mechanism ensures that the status of the lock as indicated by the sill button SB is always the same as the actual status of the lock mechanism 58 of the latch 10, ensuring that there is no doubt in the mind of a vehicle user as to the status of a particular latch 10 on their vehicle.

Numerous changes may be made within the scope of the present invention. For example, the mechanism may be adapted for use with manually actuable latches in which the electric superlock motor 82 may be replaced by a suitable linkage to a key barrel mounted on the exterior of a vehicle door to which the latch 10 is fitted and by dispensing the electric unlocking motor 68 and the associated gears. An alternatively arranged superlock link includes a single pin, and the locking mechanism may be adapted to be actuated in a linear, rather than rotary, manner. Alternative means of indicating the locked state of the latch and changing the status may be used in place of a sill button SB. Examples of these include buttons provided proximate to the inside handle ISH or the position of the inside handle ISH itself (e.g., pushed inwardly from a normal rest position when locked). The abutment surface may be provided on any body that is fixed relative to the lock link 56 and the superlock link 80. The superlock link 80 may be movably mounted on any suitable body that is rotationally fixed with the lock link 56.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A child safety mechanism for a latch for a vehicle door, the child safety mechanism comprising:

an inside release link;

a wedge block; and a wedge block support, wherein the wedge block is movable on the wedge block support between a first position wherein the wedge block moves the inside release link to a child safety off position and the inside release link is thereby actuable by a linkage for connection to an inside door handle to allow the latch to be released and a second position wherein wedging action of the wedge block moves the inside release link into a child safety on position and prevents the inside release link from being actuated by the linkage, wherein the wedge block support is a retention plate, and the retention plate includes a shut face potion arranged to be substantially aligned with a shut face of the vehicle door and an inside face portion arranged to be substantially aligned with an inside face of the vehicle door.

2. The child safety mechanism according to claim 1 wherein to the wedge block is slideably movable with respect the wedge block support.

3. The child safety mechanism according to claim 1 wherein the wedge block is supported at an intersection between the shut face portion and the inside face portion.

4. The child safety mechanism according to claim 1 including a child safety linkage connected to the wedge block and a child safety actuator connected to the child safety linkage.

5. The child safety mechanism according to claim 4 wherein the child safety actuator is a power actuator.

6. The child safety mechanism according to claim 5 wherein the child safety actuator is located in a region of the latch arranged to extend substantially parallel to the inside face of the vehicle door.

7. The child safety mechanism according to claim 4 wherein the child safety actuator is a manually operable input.

8. A latch for a vehicle door, the latch comprising:

an inside release linkage for connection to an inside door handle; and a child safety mechanism including:

an inside release link, a wedge block, and a wedge block support, wherein the wedge block is movable on the wedge block support between a first position wherein the wedge block moves the inside release link to a child safety off position and the inside release link is thereby actuable by the inside release linkage to allow the latch to be released and a second position wherein wedging action of the wedge block moves the inside release link into a child safety on position and prevents the inside release link from being actuated by the inside release linkage, wherein the wedge block support is a retention plate, and the retention plate includes a shut face portion arranged to be substantially aligned with a shut face of the vehicle door and an inside face portion arranged to be substantially aligned with an inside face of the vehicle door.

9. A child safety mechanism for a latch for a vehicle door, the child safety mechanism comprising:

an inside release link;

a wedge block; and a wedge block support, wherein the wedge block is movable on the wedge block support between a first position wherein the inside release link is in a child safety off position and is actuable by a linkage for connection to an inside door handle to allow the latch to be released and a second position wherein a wedging action of the wedge block places the inside release link in a child safety on position and prevents the inside release link from being actuated by the linkage, wherein the wedge block support is a latch retention plate and the latch retention plate includes a shut face portion arranged to be substantially aligned with a shut face of the vehicle door and an inside face portion arranged to be substantially aligned with an inside face of the vehicle door, and the wedge block is slidably movable on and supported by the latch retention plate.

10. The child safety mechanism according to claim 9 wherein the wedge block is supported at an intersection between the shut face portion and the inside face portion.

* * * * *

UNITED STATES PATENT AND TRADEMARK OFFICE

CERTIFICATE OF CORRECTION

PATENT NO. : 7,311,341 B2
APPLICATION NO. : 11/545205
DATED : December 25, 2007
INVENTOR(S) : Coleman et al.

It is certified that error appears in the above-identified patent and that said Letters Patent is hereby corrected as shown below:

Claim 1, Column 7, line 56: “potion” should read as --portion--

Claim 2, Column 7, line 61: delete “to”

Claim 2, Column 7, line 62: insert --to-- between “respect” and “the”

Signed and Sealed this

Twenty-ninth Day of April, 2008

JON W. DUDAS
*Director of the United States Patent and Trademark Office*